US006145649A

United States Patent [19]

Belanger et al.

[11] Patent Number: 6,145,649

[45] Date of Patent: Nov. 14, 2000

[54] DEVICE FOR FLEXIBLE GUIDING OF CONVEYED PRODUCTS

[75] Inventors: James Richard Belanger, Portsmouth; Kevin Lauren Cote, Durham, both of N.H.

[73] Assignee: Heidelberger Druckmaschinen AG, Heidelberg, Germany

[21] Appl. No.: 09/042,009

[22] Filed: Mar. 13, 1998

[51] Int. Cl.[7] ..... B65G 47/22; B65G 11/00

[52] U.S. Cl. ..... 198/493; 198/495; 198/644; 193/2 D

[58] Field of Search ..... 198/408, 495, 198/497, 644, 700, 493; 193/2 D

[56] References Cited

U.S. PATENT DOCUMENTS

| | | | |
|---|---|---|---|
| 3,273,534 | 9/1966 | Hyvert | 198/700 X |
| 3,416,679 | 12/1968 | Stobbs | 198/644 X |
| 4,434,979 | 3/1984 | Kobler et al. . | |
| 5,355,992 | 10/1994 | Baig et al. | 198/495 |
| 5,452,886 | 9/1995 | Cote et al. . | |
| 5,544,733 | 8/1996 | Shaver | 198/408 |
| 5,613,594 | 3/1997 | Kootsouradis | 198/495 |
| 5,641,263 | 6/1997 | Ogrinc et al. | 198/463.5 X |

FOREIGN PATENT DOCUMENTS

| | | | |
|---|---|---|---|
| 000492276 | 4/1992 | European Pat. Off. | 193/2 D |
| 0 490 272 | 6/1992 | European Pat. Off. . | |
| 0 662 439 | 7/1995 | European Pat. Off. . | |
| 0 662 439B1 | 3/1997 | European Pat. Off. . | |
| 35 13 353 | 1/1986 | Germany . | |
| 55-095081 | 2/1982 | Japan . | |

*Primary Examiner*—Christopher P. Ellis
*Assistant Examiner*—Gene O. Crawford
*Attorney, Agent, or Firm*—Burns, Doane, Swecker & Mathis, LLP

[57] ABSTRACT

The present invention is related to a method and apparatus for flexible guiding of conveyed products (i.e., signatures) from one location to another. In order to reduce the impact forces imparted onto a conveyed product, a flexible guide is deformable when receiving a signature to increase the time interval during which collision during a signature direction change occurs. With the increase in the time interval during which the collision of the signature and flexible guide occurs, the average impact forces are reduced thereby eliminating damage to the signature.

19 Claims, 4 Drawing Sheets

DEVICE FOR FLEXIBLE GUIDING OF CONVEYED PRODUCTS

BACKGROUND OF THE INVENTION

1. Field of the Invention

The present invention is related to a device for flexible guiding of conveyed flat products, particularly printed products, when conveyed from a folding apparatus to further processing lines.

2. State of the Art

In conventional web delivery systems, when a signature impacts a fixed guide, a large impact force is required to abruptly change the signature's direction. If the magnitude of this impact force is large enough, it can scrape, scratch and mark a signature's surface, causing unwanted damage. In addition, ink that may have been printed onto a signature can be scraped off of the signature as it is being transported along the guide. As a result, scraped ink can build on the guide and, in turn, be transferred back onto another signature, resulting in improper marking of that signature.

As shown in European Patent No. EP 0 662 439 B1, a pneumatic sheet guiding device is arranged in a sheet fed letterpress along a sheet conveying path. The pneumatic sheet feeding device comprises an upper part with openings to discharge blown air and an extensible lower part peripherally connected to the upper part. The upper part and the lower part form a cavity that is impermeable to air. The upper part and the lower part are both comprised of a flexible material, however, the lower part is considerably more flexible than the upper part. The upper part is bendable and the lower part is extendible such that when air is blown into the cavity formed between the upper part and lower part, an air pocket is formed which allows the lower part to change to a different curvature.

A problem occurs upon transfer of sheet-like material, such as signatures, and the changing of the direction of signatures while being conveyed at high speeds. Contact and shear forces exerted upon the signatures to be conveyed may have a damaging effect. The contact force is in a direction normal to the guide while the shear force is in a direction of the signature's motion.

Typically, a constant force exerted by one body on another in a collision results in a sharply rising force to a very large value in a relatively short period of time. The product of the average force ($F_{average}$) and the time over which the force acts ($\Delta t$) constitute the signature's force impulse (i.e., force versus time curve), and thus the signature's momentum. Accordingly, there is a need to reduce the effect of impact forces on a signature being conveyed along a path.

SUMMARY OF THE INVENTION

Given the state of the art as described above and its attendant disadvantages, it is an object of the present invention to provide an apparatus for flexible guiding of conveyed products including a flexible guide for supporting signatures. The flexible guide of the present invention is able to deform in order to increase the time interval during which collision for signature direction change occurs, the guide is supported by at least one support. The device for flexible guiding of conveyed products is particularly useful in delivery portions of a folding apparatus or in folder apparatuses, in general.

An advantage of a device according to the present invention is that an average impact force exerted upon the signature can be lowered by increasing the time interval during which the impact between the signature and guide occurs. Thus, the impact on the signature can be significantly reduced because the collision, with the guide making the signature change direction, can take place over a longer period of time.

According to further embodiments of the present invention, the flexible guide can either be a stationary or a dynamic flexible guide. Both types of guides allow for deformation to absorb an impact force upon the signature's impact on the guide. With the stationary flexible guide, the arc-length of the flexible guide allows for deformation thereof. The deformation of the flexible guide can be enhanced by mounting the flexible guide between two supports, each arranged on a different level.

According to the present invention, a flexible guide can be any desired shape, and can be formed with any width, including widths as wide as or wider than the signature's width. This allows for the forming of a natural air cushion between the signature and a non-permeable surface of the flexible guide. Furthermore, the flexible guide can also be made of permeable material so that pressurized air can be blown out through the flexible guide in order to enhance creation of an air cushion.

According to another exemplary embodiment of the present invention, instead of a stationary flexible guide, the device according to the present invention can be arranged as an endless loop traveling in the direction of the respective signature. This eliminates shear forces between the signature and the flexible guide. If the speeds of the signature and the dynamic flexible guide are matched, then the speed differential between both is eliminated resulting in a smoother signature guidance and elimination of shear forces. The flexible guide is a closed loop, and can be supported by roller shaped supports which allow for relative movement of the flexible guide with respect to the supports. At least one drive station can be assigned to the dynamic flexible guide to ensure movement. In an exemplary embodiment of the present invention, the drive station can comprise nip rollers cooperating with each other in winding the dynamic flexible guide along its path of movement.

Furthermore, the method and device according to the present invention can comprise a solution application station, for applying a liquid such as silicone, in order to reduce frictional coefficients and, consequently reduce marking. Anti-static solutions can also be applied to reduce static attraction between the guide and the signatures. Finally, a cleaning station can be assigned to the dynamic flexible guide path to remove contaminants from the surface of the dynamic flexible guide to prevent build-up of ink.

According to an exemplary embodiment present invention, a method is disclosed for providing a flexible guide which is supported by at least one support and which can deform by the impact of a signature to increase the time interval during which signature direction change occurs and thus reduce the average forces on the signature. The dynamic flexible guide can be driven such that the speed differential between the signature and dynamic flexible guide is minimized.

BRIEF DESCRIPTION OF THE DRAWINGS

The foregoing and other objects and features of the present invention will become more apparent from the following detailed description of preferred embodiments when read in connection with the accompanying drawings, wherein like elements, are represented by like reference numerals, and wherein.

DETAILED DESCRIPTION OF THE PREFERRED EMBODIMENTS

Figure 1A:
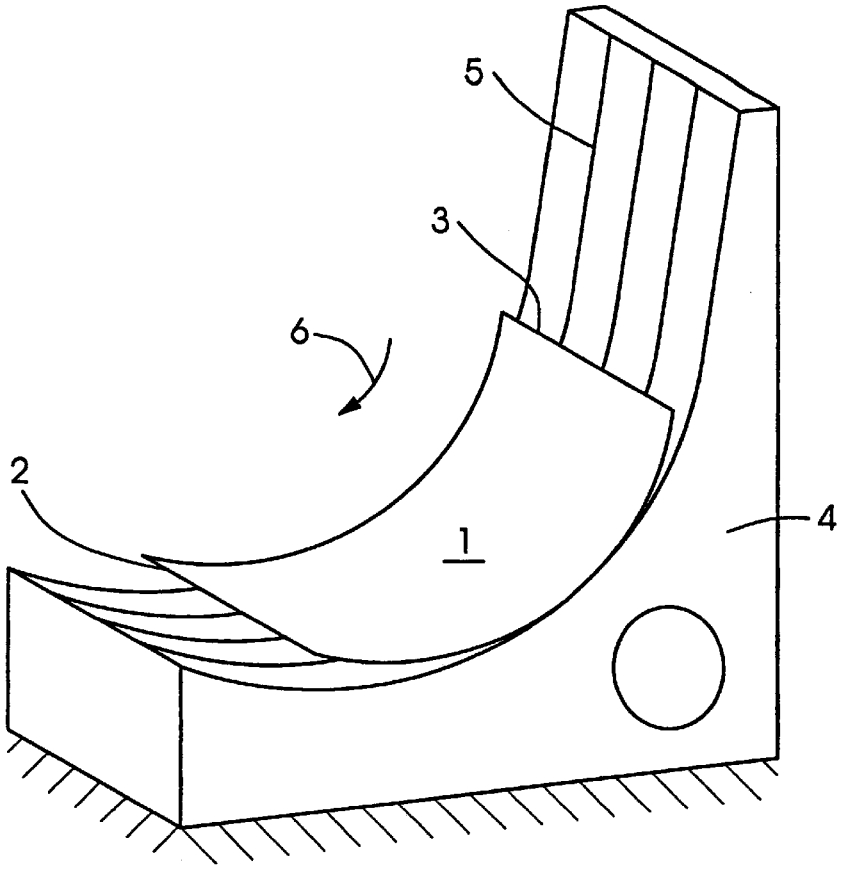
Fig.1A Prior Art
FIGS. 1A and 1B show a perspective and a side view, respectively of a conventional fixed guide.
Figure 1B:
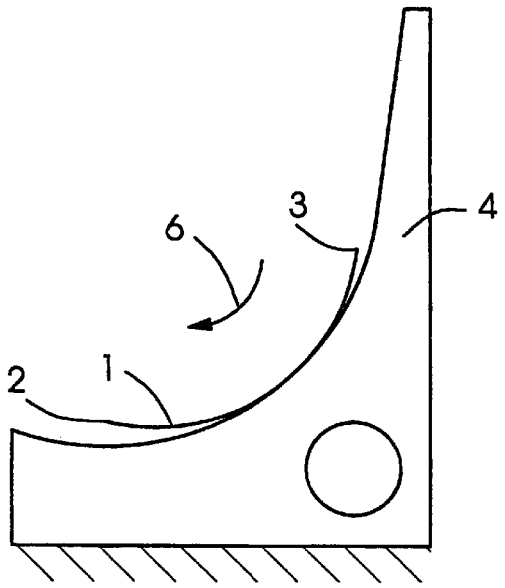
Prior Art Fig.1B

FIGS. 1A and 1B show a perspective view and side view, respectively, of a conventional fixed guide 4 on which a signature 1 is conveyed. Each signature 1 comprises a leading edge 2 and a trailing edge 3, and travels in the direction indicated by arrow 6. The trailing edge 3 of the signature 1 swings outwardly due to centripetal forces until it contacts the fixed guide 4. This guide 4, however, imparts a force on the signature 1 so that the signature 1 conforms to the shape of the fixed guide 4. By hitting the fixed guide 4, a very sharply rising force is exerted upon the signature 1 which can damage the respective signature 1.

Figure 2:
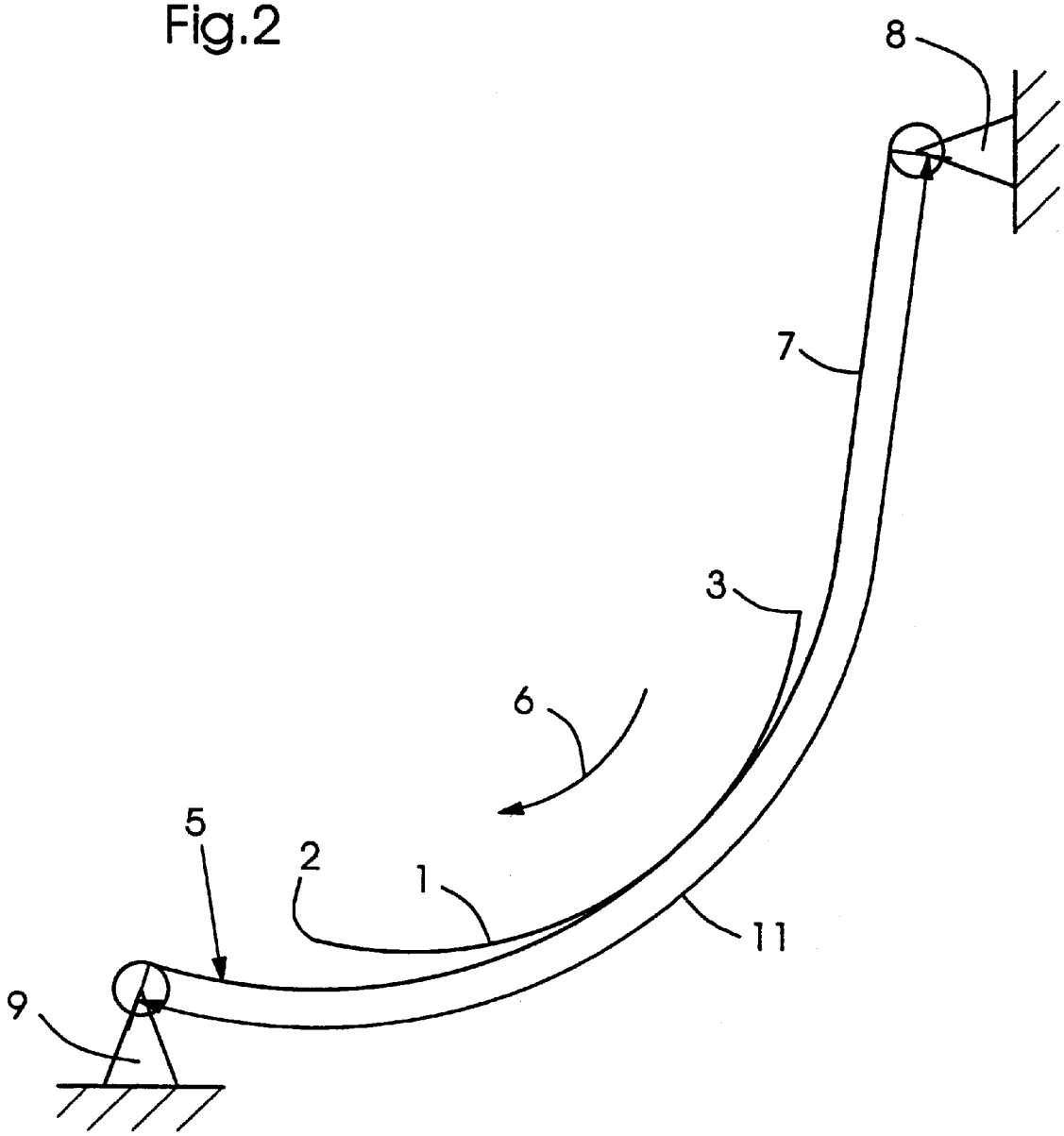
FIG. 2 shows a side view of a stationary mounted flexible guide according to an exemplary embodiment of the present invention.

FIG. 2 shows a stationary mounted flexible guide 7 according to an exemplary embodiment of the present invention. A signature's leading edge 2, held by a gripping element attached to one of a plurality of arms of a deceleration drum (not shown), is guided in direction 6. For example, a deceleration drum can be used such as that disclosed in commonly assigned U.S. Pat. No. 5,452,886, the disclosure of which is hereby incorporated by reference in its entirety. An axis about which the deceleration drum rotates can be selected such that upon rotation, the gripper elements follow a path spaced a predetermined distance from the surface of flexible guide. Because the leading edge is retained by the gripping element, it does not impact the flexible guide as the signature is decelerated during movement in the direction. However, the body of the signature 1, due to centripetal forces, will swing outward and impact the stationary, flexible guide 7.

The flexible guide 7 is mounted between an upper support 8 and a lower support 9. The supports 8 and 9 are each mounted in different planes. The arc-shaped flexible guide 7 adopts an arc-shaped position due to gravity. Reference numeral 11 depicts an arc-length between the two supports 8 and 9. The flexible guide 7 will deform upon contact with a respective signature 1, allowing the signature 1 more time to transfer an average force due to its momentum to the flexible guide 7 (i.e. the time interval of the impact increases; thus the average forces are reduced for a given momentum). The shape of the flexible guide 7, hanging down between the two supports 8, 9, respectively, can be varied by changing the length of the flexible guide 7.

The free arc-length 11 hanging between the two supports will affect the deformation and consequently the contact forces exerted. Furthermore, the degree of deformation, and therewith the increase of the time interval, can be adjusted by choosing the material properties of the flexible guides appropriately. A lighter, more flexible guide will easily conform to the shape of the signature 1 to be guided, whereas a heavier, less flexible guide will tend to force the signature to react more quickly upon impact with the flexible guide 12.

Figure 3:
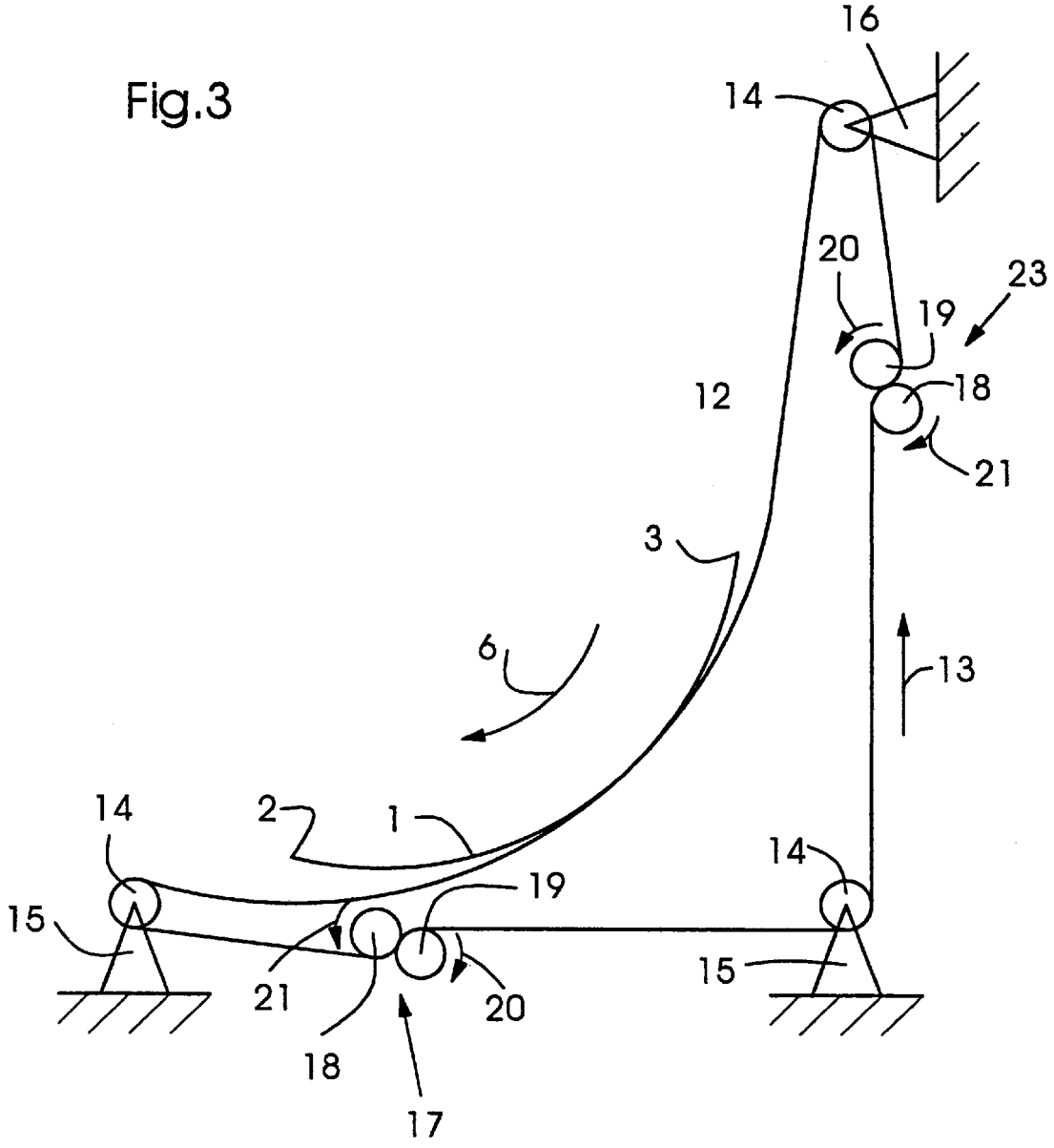
FIG. 3 shows a side view of a dynamic flexible guide arranged in a closed loop having drive stations assigned thereto in accordance with an exemplary embodiment of the present invention.

FIG. 3 shows a schematic view of a dynamic flexible guide arranged in a closed loop having drive stations assigned thereto. In this embodiment of the invention, flexible guide 12 is mounted on a plurality of roller shaped supports 14. The rollers can be arranged on supports 15 and 16, respectively. The flexible guide 12, being shaped as a closed loop, travels in a direction of arrow 13 which matches the direction of the travel of the signature 1. At least one drive station 17, 23 is assigned to the closed loop to drive the flexible guide 12 around the rollers 14 with a surface speed that can match the signature's speed in order to avoid speed differentials between the signature 1 and the surface of the flexible guide 12. The removal of a speed differential between the spaces of the signature and the speed of the guide eliminates marking on the signatures and smooths signature travel.

According to another exemplary embodiment of the present invention as shown in FIG. 3, the flexible guide 12 can be equipped with two drive stations 17 and 23 respectively. Drive station 17 is assigned to the lower end of the flexible guide 12 after it has turned about roller 14, and drive station 23 is assigned to the upper end of flexible guide 12. An additional tensioning roller 14 can be arranged in the lower right corner, and tensions the flexible guide 12 between the drive stations 17 and 23 and does not affect the shape of the flexible guide 12 on the arc shaped portion of its path. Drive stations 17 and 23 can each comprise a pair of nip rollers 18 and 19 cooperating with each other. Nip roll 19 rotates in direction 20, whereas nip roll 18 rotates in direction 21. Both drive stations 17 and 23 for the flexible guide 12 are driven synchronously in order to continuously move the flexible guide 12.

As already has been pointed out in connection with the embodiment of the present invention given in FIG. 2, the material properties of the flexible guide 12 determine the degree of deformation thereof. A lighter, more flexible material will more easily conform with a shape of the signature, whereas a heavier, less flexible material will tend to force the signature 1 to conform more quickly to the guide. The material can, for example, be either permeable (e.g., multiple strips of material, such as nylon spaced from one another, or a flexible screen) or non-permeable (i.e., sheets of any cloth-like material, such as nylon). The material can be selected to have any desired width, including a width greater than or equal to the width of the signature.

As described above, a signature 1 can be seized at its leading edge 2 by a gripping element (not shown), moved by means of a deceleration drum (not shown), to be conveyed along the flexible guide 12 according to the present invention. Between its upper and its lower supports 15, 16 respectively, the flexible guide 12 will adopt an arc shape while being driven with the same speed as that of the signature 1. Thus, no large speed differentials between the moving surface of the flexible guide 12 and the incoming signature 1 occur. Consequently, marking is eliminated because of the reduction in relative movement between two surfaces. Also, since the speed difference is reduced the effect of shear forces is significantly reduced. Upon contact with the flexible guide 12, a contact force between the flexible guide 12 and the respective signature 1 occurs which is directed normal to the flexible guide 12. The impact force to which a signature received by the flexible guide 12 is exposed corresponds to an impulse force equal to $1\ F_{average} \times \Delta t$ (i.e., the product of an average force ($F_{average}$) multiplied by the time interval of impact ($\Delta t$)). In order to reduce the average force to which the signature is exposed for a given momentum of a signature, the time interval of the collision is increased. This is accomplished by deformation of the flexible guide 12 during collision with a respective signature 1. The flexible guide 12 follows and adopts the shape of the incoming signature 1, thus prolonging the time interval At during which contact between the signature and flexible guide 12 occurs. Consequently, the average force exerted upon the signature 1 is reduced significantly.

As already mentioned, the degree of deformation of the flexible guides 7 and 12 depends, for example, on the material properties chosen for the flexible guides 7 and 12. By shaping the flexible guide 12 as wide as or wider than the respective signature 1 to be conveyed and utilizing a non-permeable material for the guide, a natural air cushion is generated between the surface of the flexible guide and the signature 1. Additional air can be introduced to an area between the signature and the guide 7 using, for example, a blower 34. Air will be entrapped between the surface of the flexible guide 12 and the signature 1, thus preventing direct contact between surfaces of the signature 1 and flexible guide 12. The effect of air entrapped between the signature 1 and the surface of the flexible guide 12 will, of course, depend upon the speed and the resulting centripetal forces exerted upon the signature 1 during rotation of the gripping element attached to an arm of a deceleration drum (not shown) or another suitable slowdown device.

In another exemplary embodiment, the guide can be made from a non-permeable material having a selected number of air holes 37, or can be made from permeable material. Air can be forced out through the permeable surface between the moving signature 1 and the surface of the flexible guide 12 by means of a blowing device 35 communication with a cavity of the guide via an optional conduit 36, the cavity being air tight except for the air holes 37.

Figure 4:
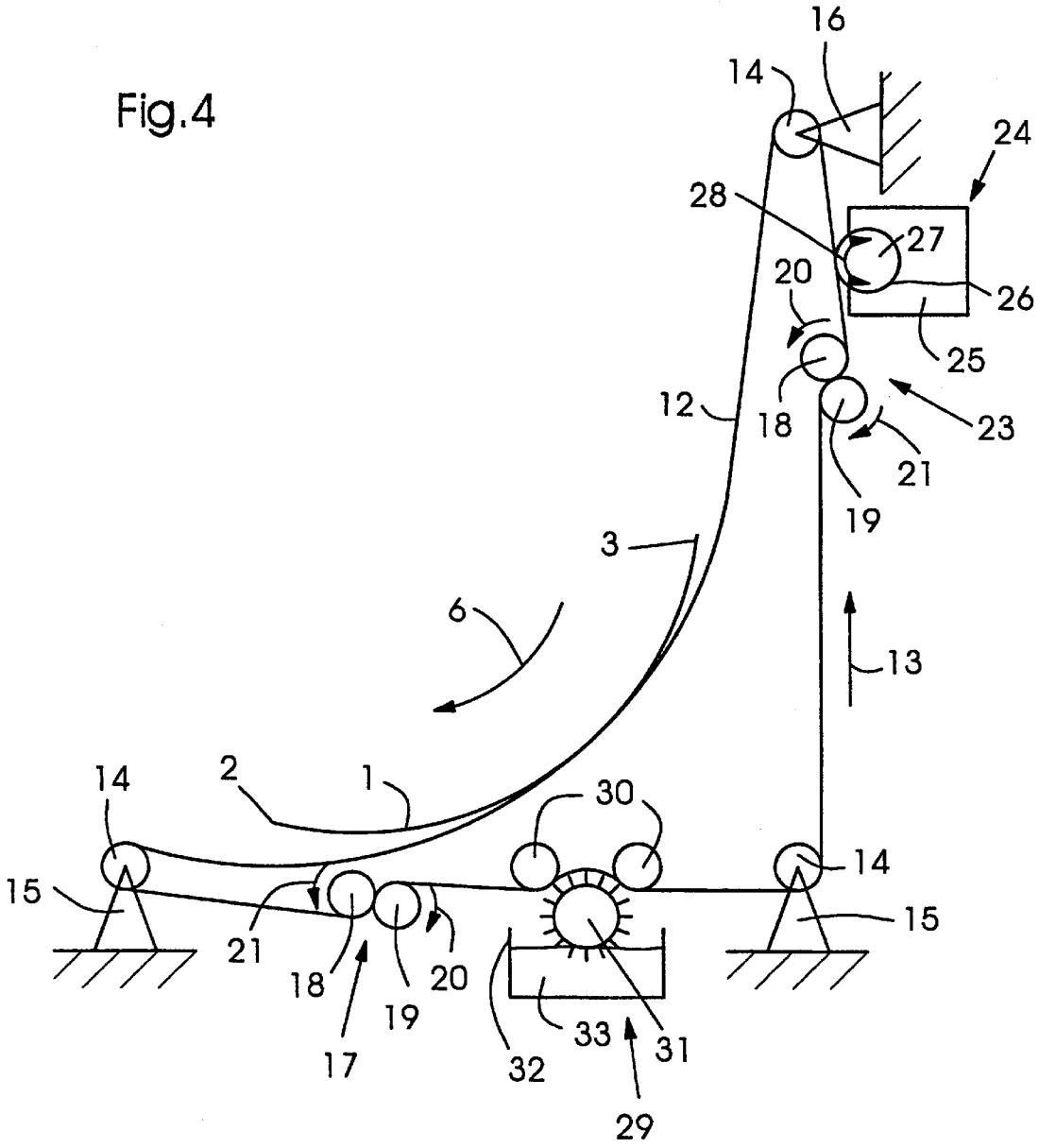
FIG. 4 shows a side view of a dynamic flexible guide including a liquid application station as well as a cleaning station for a flexible guide's surface in accordance with an exemplary embodiment of the present invention.

In accordance with another exemplary embodiment of the present invention, FIG. 4 shows a dynamic flexible guide according to FIG. 3 which also includes a liquid application station 24 as well as a cleaning station integrated into the path of the flexible guide 12. The liquid application station 24 includes a solution pan 26 containing a solution such as a silicone liquid 25. A rotating solution applicator 27 such as a pan roller applies liquid to the surface of the flexible guide 12.

By application of silicone prior to a signature 1 contacting the surface of the 10 flexible guide 12 at high speeds, the frictional coefficients are significantly reduced. In the case signatures are processed at high speeds, the generated air cushion between the signature 1 and the surface of the flexible guide 12 is not sufficient to prevent direct contact. Thus, the effects of direct contact between the signature and flexible guide 12 are minimized by reducing the frictional coefficients. This is more important for a stationary flexible guide 7, as shown in FIG. 2, than for a dynamic flexible guide 12 which is driven and where no speed differentials occur. The solution application station 24 is arranged after an upper drive station 23 to create a freshly applied, very thin coating of the surface of the flexible guide 12. In addition to silicone liquid or a silicone solution, an anti-static solution liquid can be used within the solution application station 24 to reduce static attraction between the two moving elements, signature 1 and flexible guide 12.

A cleaning station 29 on the other hand is arranged at the lower end of the flexible guide 12 after the flexible guide 12 has passed a lower drive station 17. The cleaning station 29 comprises two guide rollers 30 deforming the flexible guide 12 to ensure a sufficient contact length along which the surface of the flexible guide 12 can be cleaned by a cleaning brush 31 or the like. Cleaning brush 31 is assigned to a cleaning solution pan 32, containing a cleaning liquid to facilitate removal of contaminants from the surface of the flexible guide 12.

The present invention also discloses a method for guiding conveyed products. Flexible guides 7 and 12, as shown in FIGS. 2–4, are supported by at least one support 8, 15 and the material properties are chosen such that the flexible guide 7, 12 is deformable to increase the time interval of impact with the respective signature 1. This eliminates high contact forces directed normal to the guide exerted upon collision between two moving bodies. According to the method of the present invention, the flexible guide 12 is driven such that the speed differentials between signatures 1 and the surface of the flexible guide 12 are eliminated. Thus, shear forces between two moving bodies are eliminated or significantly reduced.

It will be appreciated by those skilled in the art that the present invention can be embodied in other specific forms without departing from the spirit or the essential character thereof. The presently disclosed embodiments are therefore considered in all respects to be illustrative and not restrictive. The scope of the invention is indicated by the appended claims rather than the foregoing description and all changes which come within the meaning and range of equivelants thereof are intended to be embraced therein.

What is claimed is:

1. Device for flexible guiding of signatures comprising:

a flexible guide for supporting a signature:

a blower, wherein said flexible guide is permeable to form an air cushion between a permeable guide surface and the signature using forced air output from said blower;

said guide being deformable during a collision between said signature and said guide to reduce force on the signature due to momentum of the signature, wherein the signature and guide conform in shape during the collision, and said guide being supported by at least one support.

2. Device for flexible guiding according to claim 1, wherein said flexible guide is as wide as or wider than said signature to allow an air cushion to form between a non-permeable guide surface and the signature.

3. Device for flexible guiding according to claim 1, wherein said flexible guide is a stationary guide.

4. Device for flexible guiding according to claim 3, wherein a length of the flexible guide is selected for deformation of the flexible guide.

5. Device for flexible guiding according to claim 3, wherein an arc-length of the flexible guide is selected for deformation of the flexible guide.

6. Device for flexible guiding according to claim 3, wherein said flexible guide is deformably mounted between supports.

7. Device for flexible guiding according to claim 1, wherein said flexible guide is a moving guide.

8. Device for flexible guiding according to claim 7, wherein said flexible guide is an endless loop, traveling in a direction of the signature.

9. Device for flexible guiding according to claim 7, wherein said flexible guide is an endless loop is driven at a surface speed which is approximately the speed of the signature.

10. Device for flexible guiding according to claim 7, wherein said flexible guide is a closed loop and is mounted on supports shaped as rollers.

11. Device for flexible guiding according to claim 7, wherein said flexible guide passes a cleaning station which removes contaminants from the flexible guide's surface.

12. Device for flexible guiding according to claim 7, wherein said flexible guide is driven by at least one drive station.

13. Device for flexible guiding according to claim 12, wherein said at least one drive station includes cooperating nip rollers winding said flexible guide in the signature's travel direction.

14. Device for flexible guiding according to claim 7, wherein said flexible guide passes a solution application station which applies a liquid to the flexible guide surface.

15. Device for flexible guiding according to claim 14, wherein the liquid solution applied is silicone.

16. Device for flexible guiding according to claim 14, wherein the liquid solution applied is an anti-static solution.

17. Folder apparatus comprising:

a flexible guide for supporting a conveyed product;

a blower, wherein said flexible guide is permeable to form an air cushion between a permeable guide surface and the conveyed product using forced air output from said blower, said guide being deformable during a collision between the conveyed product and said guide, to reduce force on the conveyed product, wherein the conveyed product and flexible guide conform in shape during the collision; and said guide being supported by at least one support.

18. Method for guiding a signature comprising the steps of:

supporting a flexible guide by at least one support;

transporting the signature to said flexible guide;

forming an air cushion between a permeable guide surface and the signature using forced air output from a blower, wherein the flexible guide is permeable, and deforming said flexible guide due to momentum of the signature, wherein the signature and flexible guide conform in shape during the collision.

19. Method for guiding a conveyed product according to claim 18, wherein said flexible guide is movable in a closed loop and is driven to minimize a speed differential between said signature and said flexible guide.

* * * * *